United States Patent [19]

Steklenski et al.

[11] 4,082,551

[45] Apr. 4, 1978

[54] ELECTROPHOTOGRAPHIC ELEMENT CONTAINING A MULTILAYER INTERLAYER

[75] Inventors: David J. Steklenski; Evelio A. Perez Albuerne, both of Rochester, N.Y.

[73] Assignee: Eastman Kodak Company, Rochester, N.Y.

[21] Appl. No.: 800,839

[22] Filed: May 26, 1977

Related U.S. Application Data

[63] Continuation-in-part of Ser. No. 783,365, Mar. 31, 1977, abandoned.

[51] Int. Cl.[2] ..... G03G 5/14

[52] U.S. Cl. ..... 96/1 PC; 96/1.5 R; 428/420

[58] Field of Search ..... 96/1 PC, 1.5, 1.8; 428/420

[56] References Cited

U.S. PATENT DOCUMENTS

| | | | |
|---|---|---|---|
| 3,373,091 | 3/1968 | Findl | 96/1.8 X |
| 3,639,122 | 2/1972 | Shimizu et al. | 96/1.5 X |
| 3,674,474 | 7/1972 | Kurokawa et al. | 96/1.5 |
| 3,682,632 | 8/1972 | Arai et al. | 96/1.8 |
| 3,745,005 | 7/1973 | Yoerger et al. | 96/1.5 |
| 3,775,108 | 11/1973 | Arai et al. | 96/1.8 |
| 3,824,148 | 7/1974 | Lopatin | 428/420 |
| 3,860,422 | 1/1975 | Matsuno et al. | 96/1.5 |
| 3,932,179 | 1/1976 | Perez-Albuerne | 96/1.5 |

FOREIGN PATENT DOCUMENTS

| | | | |
|---|---|---|---|
| 1,022,935 | 3/1966 | United Kingdom | 96/1.5 |

*Primary Examiner*—Roland E. Martin, Jr.
*Attorney, Agent, or Firm*—R. P. Hilst

[57] ABSTRACT

A unitary photoconductive element having an electrically conducting layer, a photoconductive layer thereover, and a multilayer interlayer composition interposed between the conducting layer and the photoconductive layer. The multilayer interlayer composition comprises a layer containing an acidic polymer material, a layer containing a basic polymer material, and an acid-base reaction product zone formed at the interface of the acidic polymer-containing layer and the basic polymer-containing layer. The multilayer interlayer composition provides good adhesion between the conducting and photoconductive layers of the resultant unitary element and can function as an electrical barrier blocking positive charge carriers which might otherwise be injected into the photoconductive layer from the underlying conducting layer.

18 Claims, 2 Drawing Figures

FIG. 1
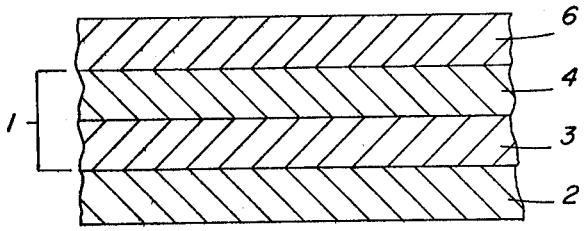
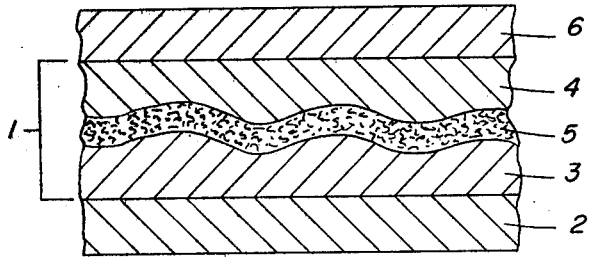
FIG. 2

ELECTROPHOTOGRAPHIC ELEMENT CONTAINING A MULTILAYER INTERLAYER

This is a continuation-in-part application of U.S. Ser. No. 783,365, filed Mar. 31, 1977, now abandoned.

FIELD OF THE INVENTION

This invention relates to electrophotography, and in particular to a unitary electrophotographic element comprising several functional layers. More particularly, the invention relates to the formulation of an interlayer composition especially suitable for use in such an element.

RELATED ART

Many procedures can be utilized to obtain an electrostatic charge pattern and to obtain a developed image. Early work is described in Carlson U.S. Pat. No. 2,297,691, issued Oct. 6, 1942, wherein a charge pattern is formed and developed on a photoconductive element.

Electrophotographic processes and elements have been described in numerous patents and other literature, for example, in the patent of Carlson, U.S. Pat. No. 2,297,691, issued Oct. 6, 1942 and in more recent works such as "Electrophotography" by R. M. Schaffert (2nd, revised edition), and "Xerography and Related Process" by Dessauer and Clark, both published by Focal Press, Ltd., the former in 1975, the latter in 1965.

Electrophotographic processes employ electrophotographic or photoconductive elements which are commonly assembled as a multilayer element on a support. A typical arrangement of layers comprises a support which is or which has on it an electrically conducting layer which has substantial dark conductivity. The outer layer is a photoconductive layer which is an insulator in the dark and under illumination becomes sufficiently conductive to allow a charge leakage through the layer. Between the electrically conducting layer and the photoconductive layer an interlayer composition may be inserted. This interlayer composition can have electrical barrier properties to prevent deleterious electrical interaction between the photoconductive species in the outer layer and the dark conductive species in the conductive layer, such interaction being quite common in many known photoconductive systems. By use of an interlayer composition having electrical barrier properties in combination with certain known types of photoconductive layers and conductive layers which otherwise are useful when charged one way only, i.e., positively or negatively, one can often prevent the above-noted deleterious interaction and thereby obtain a photoconductive layer-conductive layer combination which yields useful electrostatic images with either negative or positive charging. Alternatively or concomitantly, the interlayer composition may also serve to improve the adhesion of the multilayer system. In view of the foregoing, the presence of such interlayer compositions is found to be advantageous in many electrophotographic elements.

Various references in the technical literature have been made to suitable kinds of interlayer compositions for electrophotographic elements. For example, U.S. Pat. No. 2,901,348; U.S. Pat. No. 3,573,906; U.S. Pat. No. 3,640,708; U.S. Pat. No. 3,932,179; and British Pat. Nos. 1,059,137 and 1,225,525, describe various polymeric materials, including certain mixtures of these materials, which have been used as interlayer compositions. Certain of these interlayer compositions serve as an adhesive, some of them serve as an electrical barrier, some of them serve as a liquid hold-out layer, etc. In addition, in Example 6 of Trevoy, U.S. Pat. No. 3,428,451 it is disclosed that a two-layer system composed of a cellulose nitrate layer and a thin gelatin subbing layer provides an effective electrical barrier and provides adhesion between an organic photoconductive layer and a copper iodide-resin containing conducting layer of a multilayer electrophotographic element.

The properties of an entire multilayer photoconductive element clearly depend upon the nature of each layer and its interaction with the other layers. In particular, the interlayer composition between the conducting layer and the photoconductive layer thereof should have suitable electrical, adhesive, cohesive, and coating properties to provide a useful electrophotographic element. It is known in the art that the exact formulation of such interlayer compositions determines, in many cases, the performance of the electrophotographic element. However, the reasons why a given composition performs in a desirable way are not clearly understood at present making it virtually impossible to select a priori the composition of a useful interlayer.

Moreover, in view of the diverse electrical, chemical, and physical criteria, e.g., flexibility, adhesion, coatability, resistance to relatively high temperature and humidity conditions, and the like, imposed on interlayer compositions, it is particularly difficult to formulate single layer compositions which exhibit a satisfactory balance of properties. For this reason there has been some work in the past such as that described in the aforementioned Trevoy U.S. Pat. No. 3,428,451 to develop multilayer interlayer compositions. Although the multilayer interlayer layer compositions such as disclosed in U.S. Pat. No. 3,428,451 are useful, it would be desireable to have interlayer compositions which can be readily coated out of typical organic solvent vehicles so that the interlayer composition is compatible with conventional organic solvent production coating operations which are used in preparing many conventional multilayer photoconductive elements, especially those containing an organic photoconductive layer. In addition, it would be desireable to provide interlayer compositions which offer the opportunity of obtaining improved adhesive and cohesive properties and improved resistance to relatively high humidity and high temperature conditions. Because of the presence of the gelatin sub in the two layer compositions disclosed in Example 6 of U.S. Pat. No. 3,428,451 it is difficult, if not impossible, to prepare multilayer interlayer compositions exhibiting the aforementioned advantages and improvements with respect to organic solvent coatability, heat resistance, and humidity resistance. In addition, although the degree of adhesion exhibited by a multilayer photoconductive element composed of a conducting support, a cellulose nitrate layer, a conventional gel sub, and an organic photoconductive layer is improved over that exhibited without the gelatin sub, it would be desirable to obtain an interlayer composition having the potential to provide still further improvements in the adhesive and cohesive strength of a multilayer photoconductive element containing the same.

In view of the foregoing reasons, there has been a continual search for useful interlayer formulations to enhance the utility of multilayer electrophotographic elements.

SUMMARY OF THE INVENTION

In accord with the present invention there is provided an improved unitary electrophotographic element comprising a conductive layer, a photoconductive layer, and an improved multilayer interlayer composition having a first layer comprising a basic polymer material, a second layer comprising an acidic polymer material, the basic polymer material of such first layer and the acidic polymer material of such second layer forming an acid-base reaction product at the interface between the first and second layers of such interlayer composition.

In accord with a particularly preferred embodiment of the present invention wherein the conductive layer of the unitary electrophotographic element described herein represents a hole injecting electrode and wherein the photoconductive layer of the unitary element represents a p-type photoconductive material, particularly p-type organic photoconductive materials, the first layer of the interlayer composition described herein (which contains the acidic polymer) is located adjacent the conductive layer and the second layer of the interlayer composition described herein (which contains the basic polymeric material) is applied over such first layer between the first layer and the photoconductive layer of the unitary element. As a result, such multilayer interlayer compositions exhibit effective electrical barrier properties by blocking the injection of positive charge carriers, i.e., "holes", from the conducting layer into an electrostatically charged photoconductive layer applied thereover, while at the same time advantageously allowing rapid and substantially complete discharge of the photoconductive layer upon exposure thereof.

In accord with the present invention it has been found that the multilayer interlayer composition described herein exhibits outstanding barrier and adhesive properties effectively preventing electrical interaction between the conductive layer and the photoconductive layer, particularly organic photoconductive layers, of a unitary photoconductive element as well as providing improved adhesive and cohesive strength to the resultant unitary element. Moreover, in accord with certain preferred embodiments of the multilayer interlayer compositions of the invention, it has been found possible to produce unitary multilayer photoconductor elements exhibiting the above-noted desireable properties, even under relatively high temperature conditions, e.g., temperatures in excess of about 115° F, and under high relative humidity conditions, e.g., relative humidities in excess of 70% R.H., which can be encountered during transportation or storage of such unitary elements and, in certain cases, during use of such elements in office copier-duplicator devices.

BRIEF DESCRIPTION OF THE DRAWINGS

FIGS. 1 and 2 represent illustrations of typical cross-sections (as viewed under 2500X magnification) of certain unitary multilayer photoconductive elements as set forth in detail hereinafter.

DESCRIPTION OF THE PREFERRED EMBODIMENTS

The terms "first" layer and "second" layer as used with respect to the multilayer interlayer compositions described herein are used merely for convenience in identifying the various layers of these compositions and are not intended to indicate any particular sequential order of these layers with respect to either the conductive layer or photoconductive layer contained in the unitary electrophotographic elements of the invention. For example, the "first" layer (which is identified as containing an acidic polymer material) of the multilayer interlayer compositions can either be adjacent the conductive layer or the photoconductive layer of the unitary electrophotographic elements of the invention. However, as indicated above and as illustrated in FIG. 2 described in detail hereinafter, in accord with certain preferred embodiments of the invention it has been found especially useful to locate the "first" layer, i.e., the acidic polymer material-containing layer, of the multilayer interlayer compositions adjacent the conductive layer of the unitary elements of the invention.

The acidic polymer material used in the multilayer interlayer composition of the present invention contains at least one acidic polymer containing repeating units bearing an acidic group. Such acidic polymers may be homopolymers or copolymers and, in addition, mixtures of various acidic homopolymers or copolymers may be used to form the interlayer composition described herein. As will be appreciated by those skilled in the art, a variety of different monomers may be employed to prepare the acidic polymer contained in the described interlayer composition. The requisite acidity imparted to such polymers is supplied by using monomers containing acidic groups attached thereto. A partial listing of representative such acidic groups includes carboxyl groups, sulfonic acid groups, phosphonic acid groups, as well as the functional equivalents of such groups, such as the acid chloride and anhydride groups which are the functional equivalent of a carboxyl group. Of course, any other equivalent acidic groups familiar to those skilled in the art of polymer chemistry may also be employed within the scope of the present invention.

A partial listing of typical acid group-containing monomers useful in preparing the acidic polymers employed in the present invention includes the following materials:

aconitic acid
2-acrylamido-2-methylpropanesulfonic acid
3-acrylamidopropane-1-sulfonic acid
acrylic acid
methacrylic acid
4-acryloyloxybutane-1-sulfonic acid
3-acryloyloxypropionic acid
3-acryloyloxybutane-1-sulfonic acid
3-acryloxypropane-1-sulfonic acid
4-t-butyl-9-methyl-8-oxo-7-oxa-4-aza-9-decene-1-sulfonic acid
α-chloracrylic acid
maleic acid
chloromaleic acid
2-methacryloyloxyethyl-1-sulfonic acid
citraconic acid
crotonic acid
fumaric acid
mesaconic acid
α-methyleneglutaric acid
monoethyl fumarate
monomethyl α-methyleneglutarate
monomethyl fumarate
vinylsulfonic acid
styrenesulfonic acid
4-vinylbenzylsulfonic acid
vinylphosphonic acid maleic anhydride
citraconic acid anhydride The basic polymer material used in preparing the interlayer composition employed in the present invention may be prepared from any of a variety of basic group-containing monomers. Homopolymer and copolymer materials prepared from such basic group-containing monomers can also be used as well as mixtures of such homopolymers and copolymers. In accord with particularly preferred embodiments of the present invention such basic polymeric materials exhibit their characteristic basicity due to the presence of amine groups attached to one or more repeating units contained in such polymeric materials. Such amine groups may be selected from any one of a variety of primary, secondary, and tertiary amines as well as heterocyclic amines.

A partial listing of representative primary amine-containing monomers useful in preparing the basic polymers employed in the present invention includes the following materials:

N-(2-amino-2-methylpropyl)methacrylamide
2-aminoethyl methacrylate
p-aminostyrene
N-(2-aminoethyl)methacrylamide
N-(3-aminopropyl)methacrylamide
N-vinyl-N'-(2-amino-2-methylpropyl)succinamide A partial listing of representative secondary amine-containing monomers useful in the present invention includes:

2-(t-butylamino)ethyl methacrylate
N-methyl-2-aminoethyl methacrylate

A partial listing of representative tertiary amine-containing monomers useful in the present invention includes the following materials:

1,3-bis(dimethylamino)isopropyl methacrylate
4-(N,N-diethylamino)-1-methylbutyl acrylate
2-(N,N-diethylamino)ethyl acrylate
2-(N,N-diethylamino)ethyl methacrylate
3-(N,N-diethylamino)propyl acrylate
N-(1,1-dimethyl-3-dimethylaminopropyl)acrylamide
3,6-dimethyl-3,6-diazaheptyl acrylate
2-(N,N-dimethylamino)ethyl acrylate
2-(N,N-dimethylamino)ethyl methacrylate
N-(2-N,N-dimethylaminoethyl)acrylamide
N-(2-N,N-dimethylaminoethyl)methacrylamide
N-[3-(N,N-dimethylamino)propyl]acrylamide
vinylbenzyldimethylamine A partial listing of representative heterocyclic amine-containing monomers useful in the present invention includes the following materials:

N-acryloylpiperidine
2-(5-ethyl-2-pyridyl)ethyl acrylate
2-phenyl-1-vinylimidazole
2-methyl-1-vinylimidazole
1-vinylimidazole
2-methyl-5-vinylpyridine
2-vinylpyridine
4-vinylpyridine
N-(γ-dimethylaminopropyl)maleimide As will be recognized from the partial listing of representative primary, secondary, and tertiary amine-containing monomers cited hereinabove, useful amine-containing monomers in the present invention includes both aliphatic and aromatic amines.

It will, of course, be appreciated that various functional equivalents of amine-containing monomers can also be employed in the basic polymeric materials used in the present invention.

In accord with certain preferred embodiments of the present invention the acidic and basic polymers used in preparing the multilayer compositions described herein also contain, in addition to the above-described acid and basic-group containing repeating units, repeating units derived from compatible, non-interfering monomers. These non-interfering monomers may be selected from a wide variety of materials having useful physical properties such as desireable solubility properties, flexibility properties, glass transition temperature properties, and the like, such monomers being selected so as to be compatible with the acidic and basic-group containing monomers with which they are to be polymerized and being incapable of interfering with the acid-base reaction product formed at the interface of the acidic and basic polymer-containing layers used in the present invention. The term "compatible" monomer is used herein to designate those monomers which can readily be copolymerized with the particular acidic group- or basic group-containing monomer(s) of choice and which, when so polymerized, provide resultant polymeric materials which can be applied by conventional coating techniques. A partial listing of representative polymerizable, ethylenically unsaturated non-interfering monomers includes the following: vinylesters such as vinylacetate; alkyl and aryl acrylic acid esters such as methyl acrylate and butyl acrylate; alkyl and aryl methacrylic acid esters such as methyl methacrylate; styrene and substituted styrene monomers such as methylstyrene and divinyl benzene; olefinic monomers such as ethylene, propylene, chlorinated olefins such as vinylchloride, vinylidene chloride; and other vinyl monomers such as acrylonitrile.

It will further be appreciated that the acidic and basic-containing polymeric layers used in the multilayer interlayer compositions of the invention may also contain as separate components thereof additional compatible, non-interfering polymeric materials physically admixed therein to provide desired physical properties to the resultant interlayer. Here again, of course, such non-interfering polymers must be compatible with the particular acidic or basic polymeric materials contained in a specific layer so that these respective layers can be readily coated from conventional liquid coating vehicles.

A partial listing of representative acidic polymers useful in the present invention includes a wide variety of homopolymers and copolymers composed of a polymerized blend of the above-described acidic monomer(s) and, if desired, one or more compatible, non-interfering monomers. Typical such polymers are poly(methyl methacrylate-co-methacrylic acid), poly(acrylic acid), poly(methacrylic acid), poly(ethylene-co-maleic acid, poly(styrene sulfonic acid), poly(vinyl hydrogen phthalate), etc.

A partial listing of representative basic polymers useful in the present invention includes a wide variety of homopolymers and copolymers composed of a polymerized blend of the above-described basic monomer(s) and, if desired, one or more compatible, non-interfering monomers. Typical such polymers are poly(2-vinylpyridine-co-methyl methacrylate), poly[styrene-co-N-(γ-dimethylaminopropyl)maleimide], poly(4-vinylpyridine), poly[2-(N,N-dimethylamino)ethyl methacrylate-co-methyl methacrylate], poly(styrene-co-vinylbenzyldimethylamine), poly{N-[3-(N,N-dimethylaminopropyl)]acrylamide}, etc.

The amount of repeating units containing acidic and basic groups present in the acidic and basic polymer layers, respectively, of the multilayer interlayer compositions described herein can vary widely. In general, one must have sufficient acidic and basic groups present to produce the acid-basic reaction product zone at the interface of these two layers. Because the attainment of this acid-base reaction product zone can be monitored visually by examining 2500X photomicrograph cross-sections of an element containing such multilayer interlayer compositions, one can readily determine the minimum amount of a particular acidic monomer or basic monomer needed in a specific interlayer formulation to provide the desired acid-base reaction product. (See the description provided hereinafter relative to the acid-base reaction product zone when viewed under 2500X magnification.) Typically, it has been found that acidic polymer layers and basic polymer layers prepared from polymerizable monomer mixtures containing at least about 10 mol percent of acidic- and basic-containing monomers, respectively, provide useful multilayer interlayer compositions in accord with the present invention.

It should be recognized that the particular acidic polymer and basic polymer materials used in preparing the multilayer interlayer compositions described herein and that the particular acidic and basic groups which are present in these polymeric materials to impart thereto the necessary basicity and acidity are not broadly critical to the present invention. Rather, what is critical to the present invention is that the acid polymer layer contain a polymer(s) which has sufficient acidity and that the basic polymer layer contain a polymer(s) which has sufficient basicity such that an acid-base reaction product between these two layers can be formed at the interface thereof. Accordingly, the particular acid and basic group-containing monomers used to form the layers of the multilayer interlayer compositions described herein can be widely varied so long as the materials selected are capable of forming the required acid-base reaction product.

In general, the presence of an acid-base reaction product at the interface between the first and second layers of the multilayer interlayer compositions described herein can readily be discerned by an examination of a photomicrograph of the cross-sectional area of a unitary electrophotographic element of the invention. For example, photomicrographs made at 2500X magnification of a thin layer cross-section of the unitary electrophotographic elements of the invention clearly reveals the presence of an acid-base reaction product zone formed at the interface between the layer containing the acid polymer(s) and the layer containing the basic polymer(s). In contrast, a similar 2500X photomicrograph of typical multilayer interlayer compositions such as those illustrated in the prior art (see Example 6 of the above-noted U.S. Pat. No. 3,428,451), reveals a two layer structure with no reaction product zone at the interface of the two layers forming the multilayer interlayer structure.

Drawings illustrative of some of the differences between typical prior art multilayer interlayer compositions and the multilayer interlayer compositions of the present invention which exhibit an acid-base reaction product zone at the interface of the acidic polymer layer and the basic polymer layer thereof are set forth in attached FIGS. 1 and 2. In each of FIGS. 1 and 2, layers 2 and 6 represent a conductive support and a photoconductive layer, respectively. FIG. 1 represents a typical prior art multilayer interlayer composition 1 (e.g., that described in Example 6 of U.S. Pat. No. 3,428,451) coated on an electrically conductive support 2. As is apparent and as represented in FIG. 1, layers 3 and 4 of interlayer composition 1 represent separate, discrete layers with no intervening reaction product zone therebetween. Moreover, as shown in FIG. 1, the line of the demarcation between layers 3 and 4 of interlayer composition 1 typically appears as a uniform line of demarcation. In contrast, in FIG. 2 which illustrates the interlayer composition 1 of the present invention, it is apparent that there is a visible reaction product zone 5 formed at the interface of layers 3 and 4 of interlayer composition 1. The acid-base reaction product zone 5 formed at the interface of layers 3 and 4 in FIG. 2 is typically formed in situ as layer 4 is applied to the surface of layer 3. Furthermore, as illustrated in FIG. 2, the acid-based reaction product zone 5 formed at the interface of layers 3 and 4 often forms an irregular reaction product zone, such irregular reaction zone interface also being characteristic of typical multilayer interlayer compositions of the present invention.

To provide further assistance in identifying various combinations of acidic polymers and basic polymers which are useful in forming the multilayer interlayer described herein, the following off-line Acid-Base Reaction Product Formation Test has been devised.

Acid-Base Reaction Product Formation Test 2.0 g. of polymeric material to be evaluated as a useful acidic polymer material and 2.0 g. of polymeric material to be evaluated as a useful basic polymer material are individually dissolved in separate containers, each container containing 100 ml. of a common organic solvent, e.g., methanol, for the two polymeric materials. The two separate 100 ml. solutions thus obtained are then admixed together in a common container, typically at 22° C at about 50% relative humidity. If such mixing results in the formation of an insoluble reaction product, this indicates that the two polymer materials selected for evaluation are useful in combination to form the multilayer interlayer composition used in the unitary photoconductive elements of the present invention. The formation of the above-described insoluble reaction product is indicative of the formation of the acid-base reaction product zone formed at the interface of the acidic polymer layer and basic polymer layer present in the multilayer interlayer compositions of the present invention.

In accord with a particularly preferred embodiment of the present invention the multilayer interlayer compositions described herein are used in combination with a unitary electrophotographic element having a conductive layer composed of an electrically conductive hole injecting material, e.g., copper iodide, and a photoconductive layer composed of a p-type photoconductive material, i.e., a hole transporting photoconductor, particularly a p-type organic photoconductive material.

In accord with this embodiment of the invention the acidic and basic polymers used in preparing the resultant unitary element are soluble in organic solvents, such as lower alkanol solvents, e.g., methanol, ethanol, etc. For this reason, each of the acidic polymer layer and the basic polymer layer may be coated from organic solvents. Because many, if not most, conventional organic photoconductor-containing compositions are preferably coated using organic solvent vehicles, this aspect of the invention is particularly advantageous. This means the multilayer interlayer and photoconductive layer compositions can be coated on production scale during equipment using organic solvent coating vehicles for these compositions so that one does not have to worry about the production problems and expense which can result when one attempts to prepare a multilayer element wherein the individual layers thereof require the use of both aqueous and organic solvent vehicles.

A further advantage of the above-noted preferred embodiment of the invention resides in the fact that although acidic polymer layers may, in certain cases, provide useful electrical barrier properties between hole-injecting electrically conducting layers and p-type organic photoconductive layers, organic-soluble acidic polymer layers often do not provide the desired degree of adhesion to the overlying organic photoconductor-containing layer. Moreover, the acidic groups or other groups present in the acidic polymer layers which are capable of undergoing hydrolysis to form acidic groups have been identified as a potential source of undesireable chemical interaction with the organic photoconductive materials present in certain p-type organic photoconductor-containing layers. Such undesirable chemical interactions have a tendency to produce premature failure, particularly premature electrical fatigue, of the overlying organic photoconductive materials. This can be especially troublesome when dealing with high speed copier-duplicator machines which require the employment of reuseable photoconductive elements capable of undergoing a large number of imaging cycles before replacement thereof to achieve efficient operation of the machine.

In accord with certain preferred embodiments of the present invention, the above-noted adhesion and electrical fatigue problems associated with the use of interlayer compositions containing acidic polymer materials can be reduced or substantially eliminated. That is, in accord with these embodiments of the present invention, the acidic polymer-containing layer is separated from the photoconductive layer by the intervening basic polymer-containing layer. Organic solvent soluble basic polymers have been found to provide improved adhesion between organic photoconductor-containing layers and the underlying layers of the unitary photoconductive elements described herein and these basic polymer-containing layers have been found to cause little or no premature electrical fatiguing of overlying p-type organic photoconductor-containing layers.

The precise reasons why the multilayer interlayer compositions of the present invention are capable of providing the above-described benefits and advantages are not fully understood. In fact, because the basic polymer materials used herein are typically organic solvent soluble in the same halogenated hydrocarbon organic solvent coating vehicles typically used to apply organic photoconductive layers, one might expect that the organic solvent coating vehicles used in applying the overlying photoconductive layer would solubilize and tend to wash off the basic polymer layer of these multilayer interlayer compositions, thereby effectively destroying any potentially useful electrical barrier and adhesive properties these interlayers might otherwise provide. However, this does not occur. The reason why this does not occur is not completely understood, but it is believed to be due to the formation of the above-described acid-base reaction product zone formed at the interface of the multilayer interlayer structure. This acid-base reaction product is generally insoluble in conventional halogenated hydrocarbon organic solvent coating vehicles used to apply the photoconductive layer. For this reason, the multilayer interlayer compositions described herein also exhibit advantageous solvent hold-out or solvent barrier properties. Moreover, as a result of the chemical bonding provided by this acid-base reaction product at the interface of the multilayer interlayer composition, it is believed that this reaction product also contributes substantially to the improved adhesion between interlayers of the multilayer photoconductive elements of the invention and to the overall cohesive strength exhibited by such multilayer elements.

As indicated, the multilayer interlayer compositions of the present invention are located in a unitary photoconductive element between an overlying photoconductive composition and an underlying conductive layer such as a conductive support. It will be appreciated that the resultant multilayer interlayer composition is sufficiently thin so that it does not interfere with the necessary electrical contact between the overlying photoconductive layer and the underlying conducting layer. Typically, the total dry thickness of the multilayer interlayer composition of the present invention is within the range of from about 0.04 to about 2.0 micron, preferably from about 0.2 to about 1.0 micron.

Suitable conducting layer materials useful in the elements of the present invention include any of a wide variety of electrical conducting supports, for example, paper (at a relative humidity above 20 percent); aluminum-paper laminates; metal foils, such as aluminum foil, zinc foil, etc.; metal plates, such as aluminum, copper, zinc, brass and galvanized plates; vacuum deposited metal layers, such as silver, nickel, chromium, aluminum and the like coated on paper or conventional photographic film base such as cellulose acetate, polystyrene, poly(ethylene-terephthalate), etc. Such conducting materials as nickel can be vacuum deposited on transparent film supports in sufficiently thin layers to allow electrophotographic layers prepared therefrom to be exposed through the transparent film support if so desired. An especially useful conducting support can be prepared by coating a support material such as poly(ethylene-terephthalate), with a conducting layer containing semiconductors cuprous iodide, e.g., dispersed in a resin. Such conducting layers both with and without electrical barrier layers are described in U.S. Pat. No. 3,245,833 by Trevoy issued Apr. 12, 1966 and the above-noted Trevoy, U.S. Pat. No. 3,428,451. Other useful conducting layers include compositions consisting essentially of an intimate mixture of at least one protective inorganic oxide and from about 30 to about 70 percent by weight of at least one conducting metal, e.g., a vacuum-deposited cermet conducting layer as described in Rasch, U.S. Pat. No. 3,880,657, issued Apr. 29, 1975. Likewise, a suitable conducting coating can be prepared from the sodium salt of a carboxyester lactone of maleic anhydride and a vinyl acetate polymer. Such kinds of conducting layers and methods for their preparation and use are disclosed in U.S. Pat. No. 3,007,901 by Minsk issued Nov. 7, 1961 and U.S. Pat. No. 3,262,807 by Sterman et al issued July 26, 1966. Suitable conducting layers can also be prepared from organic conductors and semiconductors, for example, the materials described in U.S. Pat. Nos. 3,634,336 and 3,754,986; French Pat. No. 2,084,997; and U.S. patent application Ser. No. 654,440 filed Feb. 2, 1976.

The photoconductive insulating composition employed in the multilayer elements of the present invention may be composed of a wide variety of organic, including organometallic, or inorganic photoconductive materials optionally in admixture with an electrically insulating, film-forming binder material. Optionally, various sensitizing materials such as spectral sensitizing dyes and chemical sensitizers may also be incorporated therein. In general, typical photoconductive compositions employed in the present invention contain an amount of photoconductor equal to at least about 1 weight percent based on the total dry weight of the photoconductive composition and, preferably, at least about 15% by weight based on the total weight of the photoconductive composition. The upper limit in the amount of photoconductive material present in a particular photoconductive composition can be widely varied depending upon the sensitivity of the specific photoconductor under consideration, its compatability with a particular binder component, and the like. In fact, in the case where the particular photoconductive composition under consideration contains as a photoconductor a polymeric photoconductive material, such polymeric photoconductor may be the sole component of the photoconductive composition because the polymeric nature of the material can act as a polymeric binder. However, more typically, even in the case where polymeric photoconductors are employed in photoconductive compositions used in elements of the present invention, it is often desirable to incorporate a separate binder which is specifically selected to provide useful electrically insulating, film-forming properties. Typically, when a separate polymeric binder component is present, it is used in the photoconductive compositions employed in the invention in an amount within the range of from about 85 to about 10% by weight based on the total dry weight of the photoconductive composition.

As indicated, a wide variety of different photoconductors, including inorganic, organic, including metallo-organic and organic polymeric photoconductors, may be used in the photoconductive compositions employed in the present invention. A variety of such materials are well known in the art and an extended list thereof is considered unnecessary herein. Such materials include, for example, zinc oxide, lead oxide, selenium, various particulate organic pigment materials such as phthalocyanine pigments, and a wide variety of well-known organic compounds including metallo-organic and polymeric organic photoconductors. A partial listing of representative photoconductive materials may be found, for example, in Research Disclosure, Vol. 109, May 1973, page 61, in an article entitled "Electrophotographic Elements, Materials and Processes", at paragraph IV(A) thereof. This partial listing of well-known photoconductive materials is hereby incorporated by reference.

In general, the photoconductive compositions employed in the element of the present invention may be prepared in the usual manner, i.e., by blending a dispersion or solution of the photoconductive material together with a binder and coating or otherwise forming a layer of such photoconductive composition on an underlying layer.

As indicated, various photoconductive compositions employed in the invention can be sensitized by the addition of amounts of sensitizing compounds effective to provide improved electrophotosensitivity. Sensitizing compounds useful in various photoconductive compositions can be selected from a wide variety of such materials, including various pyrylium dye salts such as pyrylium, bispyrylium, thiapyrylium, and selenapyrylium dye salts as disclosed in VanAllan et al U.S. Pat. No. 3,250,615; fluorenes, such as 7,12-dioxo-13-dibenzo(a,h)fluorene and the like; aromatic nitro compounds of the kind described in U.S. Pat. No. 2,610,120; anthrones like those disclosed in the U.S. Pat. No. 2,670,284; quinones such as those described in U.S. Pat. No. 2,670,286; benzophenones, such as described in U.S. Pat. No. 2,670,287; thiazoles, such as described in U.S. Pat. No. 3,732,301; various dyes such as cyanine (including carbocyanine), merocyanine, diarylmethane, thiazine, azine, oxazine, xanthene, phthalein, acridine, azo, anthraquinone dyes, and the like and mixtures thereof.

Where a sensitizing compound is employed in a photoconductive composition used in the present invention, it is a normal practice to mix a suitable amount of a sensitizing compound with the coating composition so that, after thorough mixing, the sensitizing compound is uniformly distributed in the coated layer.

Other methods of incorporating a sensitizing compound or the effects thereof may, however, be employed consistent with the practice of the invention. Of course, in preparing the photoconductive compositions used in the present invention, no sensitizing is required in such layers where the particular photoconductors employed exhibit sufficient photosensitivity in the desired regions of the spectrum without use of a sensitizer. In general, although the optimum concentration in any given case will vary depending on the specific photoconductor and sensitizing compound selected, substantial speed gains can usually be obtained wherein appropriate sensitizing compound is added in a concentration within the range of from about 0.001 to about 30% by weight based on the dry weight of the photoconductive insulating composition, preferably an amount within the range of from about 0.005 to about 10% by weight based on the dry weight of the photoconductive insulating composition.

With respect to the various binder materials which may be employed in the photoconductive compositions used in the present invention, preferred binders are film-forming, hydrophobic polymeric materials having fairly high dielectric strength and good electrically insulating properties. Materials of this type include styrene-butadiene copolymers; silicone resins; styrene-alkyd resins; silicone-alkyd resins; soya-alkyd resins; poly(vinyl chloride); poly(vinylidene chloride); vinylidene chloride-acrylonitrile copolymers; poly(vinyl acetate); vinyl acetate-vinyl chloride copolymers; poly(vinyl acetals), such as poly(vinyl butyral); polyacrylic and methacrylic esters, such as poly(methyl methacrylate), a poly-(n-butyl methacrylate), poly(isobutyl methacrylate), etc.; polystyrene; nitrated polystyrene; polymethylstyrene; isobutylene polymers; polyesters, such as poly[ethylene-co-alkylene-bis(alkylene-oxyaryl)-phenylenedicarboxylate]; phenolformaldehyde resins; ketone resins; polyamides; polycarbonates; polythiocarbonates; poly[ethylene-co-isopropylidene-2,2-bis(ethylene-oxyphenylene)terephthalate]; copolymers of vinyl haloarylates and vinyl acetate such as poly-(vinyl-m-bromobenzoate-co-vinyl acetate); etc. Methods of making resins of this type have been described in the prior art, for example, styrene-alkyd resins can be prepared according to the method described in Gerhart U.S. Pat. No. 2,361,019, issued Oct. 24, 1944 and Rust U.S. Pat. No. 2,258,423, issued Oct. 7, 1941. Suitable resins of the type contemplated for use in the photoconductive layers of the invention are sold under such trademarks as Vitel PE-101, Cymac, Piccopale 100, Saran F-220, and Lexan 145. Other types of binders which can be used in photoconductive layers include such materials as paraffin, mineral waxes, etc.

Various coating vehicles for preparing photoconductive compositions useful in the present invention include a variety of well-known such solvent materials. Typically, volatile organic solvents have been found quite effective. Representative solvents include: aromatic hydrocarbons such as benzene, including substituted aromatic hydrocarbons such as toluene, xylene, mesitylene, etc.; ketones such as acetone, 2-butanone, etc.; halogenated aliphatic hydrocarbons such as methylene chloride, chloroform, ethylene chloride; ethers including cyclic ethers such as tetrahydrofuran, diethyl ether; and mixtures of the foregoing.

In accord with one especially preferred embodiment of the present invention, the photoconductive insulating composition contained in the photoconductive element of the invention is a homogeneous p-type organic photoconductive composition containing an electrically insulating film-forming polymeric binder and an organic photoconductor(s) in solid solution in said binder. Optionally, one or more sensitizing compounds, such as one of the above-described pyrylium, bispyrylium, thiapyrylium or selenapyrylium materials may also be incorporated therein. Such photoconductive compositions are readily coated from organic solvents and when used with appropriate sensitizing compounds exhibit very useful ranges of photosensitivity. In addition, such compositions because of their optical homogeneity provide resultant visible images which exhibit a high degree of resolution. Among the various organic photoconductive materials which may be incorporated in such homogeneous compositions are any of the various organic photoconductive materials set forth in the above-referenced *Research Disclosure* article in paragraphs IV(A)(2) through IV(A)(12). Especially useful such photoconductive materials include p-type organic photoconductive materials having in the molecular structure thereof one or more organic groups typically referred to in the art as arylamine groups and polyarylalkane groups. Still another group of useful such p-type organic photoconductive materials useful in the photoconductive compositions employed in the present invention are various pyrrole organic photoconductors such as those described in U.S. Pat. No. 3,174,854 issued Mar. 1965 and U.S. Pat. No. 3,485,625 issued Dec. 23, 1969.

A partial listing of specific p-type arylamine-containing organic photoconductors includes diarylamines, the particular non-polymeric triphenylamines illustrated in Klufel et al, U.S. Pat. No. 3,180,730, issued Apr. 27, 1965; the triarylamines having at least one of the aryl radicals substituted by either a vinyl radical or a vinylene radical having at least one active hydrogen-containing group as described in Brantly et al U.S. Pat. No. 3,567,450 issued Mar. 2, 1971; the triarylamines in which at least one of the aryl radicals is substituted by an active hydrogen-containing group as described in Brantly et al U.S. Pat. No. 3,658,520 issued Apr. 25, 1972; tritolylamine; and various polymeric arylamine-containing photoconductors such as those described in Fox U.S. Pat. No. 3,240,597, issued Mar. 15, 1966 and Merrill et al U.S. Pat. No. 3,779,750, issued Dec. 18, 1973.

Among the various specific polyarylalkane photoconductor materials which may be used in accordance with the present invention are the polyarylalkane materials such as those described in Noe et al U.S. Pat. No. 3,274,000 issued Sept. 20, 1966; Wilson U.S. Pat. No. 3,542,547 issued Nov. 24, 1970; Seus et al U.S. Pat. No. 3,542,544 issued Nov. 24, 1970; Rule U.S. Pat. No. 3,615,402 issued Oct. 26, 1971; Rule U.S. Pat. No. 3,820,989 issued June 28, 1974; and Research Disclosure, Vol. 133, May 1975, pages 7–11, entitled "Photoconductive Composition and Elements Containing Same". Preferred polyarylalkane photoconductive materials useful in the present invention can be represented by the formula:

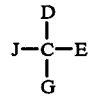

wherein D and G, which may be the same or different, represent aryl groups and J and E, which may be the same or different, represent a hydrogen atom, an alkyl group, or an aryl group, at least one of D, E and G containing an amino substituent. An especially useful polyarylalkane photoconductor which may be employed in the present invention is one having the formula noted above wherein J and E represent a hydrogen atom, an aryl group, or an alkyl group and D and G represent substituted aryl groups having as a substituent thereof a group represented by the formula:

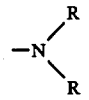

wherein R represents an unsubstituted aryl group such as phenyl or an alkyl substituted aryl such as a tolyl group. Additional information concerning the above-described preferred polyarylalkane photoconductors can be found by reference to the foregoing U.S. patents.

A partial listing of representative p-type organic photoconductors useful in the present invention is presented hereinafter as follows:

1. tri-(p-tolyl)amine;
2. bis(4-diethylamino-2-methylphenyl)phenylmethane;
3. bis(4-diethylaminophenyl)diphenylmethane;
4. 4-(di-p-tolylamino)-4'-(di-p-tolylamino)-$\beta$-styryl]stilbene;
5. 2,3,4,5-tetraphenylpyrrole; and
6. 1,1-bis(4-di-p-tolylaminophenyl)cyclohexane.

In accord with yet another especially useful embodiment of the present invention, the multilayer interlayer compositions described herein may be used as an interlayer composition for a "heterogeneous" or "aggregate" multiphase photoconductive composition as described in Light U.S. Pat. No. 3,615,414 issued Oct. 26, 1971 and Gramza et al U.S. Pat. No. 3,615,396 issued Oct. 26, 1971. Such multiphase aggregate photoconductive compositions typically comprise a continuous binder phase containing dispersed therein a particulate, co-crystalline complex of (i) a pyrylium-type dye salt such as a 2,4,6-substituted thiapyrylium dye salt and (ii)

a polymer having an alkylidenediarylene group in a recurring unit thereof, e.g., a bisphenol A polycarbonate. Preferably, although not required, one or more organic photoconductors are contained in solid solution with the continuous binder phase of the aggregate photoconductive composition. For detailed reference and other information concerning particular components and methods of preparation of the above-described aggregate photoconductive compositions reference may be made to the foregoing Light and Gramza et al patents hereby incorporated by reference.

In accord with yet a further embodiment of the present invention, the multilayer interlayer compositions described herein may be employed in a multilayer photoconductive element wherein the photoconductive composition is composed of two or more separate layers such as the "multi-active" photoconductive insulating composition described in copending Berwick et al application U.S. Ser. No. 639,039, filed Dec. 9, 1975, hereby incorporated by reference. Such "multi-active" photoconductive compositions contain a charge-generation layer in electrical contact with a charge-transport layer. The charge-generation layer of such a "multi-active" composition comprises a multiphase "aggregate" composition as described hereinabove. The charge-transport layer of such "multi-active" compositions comprises an organic photosensitive charge-transport material such as described in the aforementioned Berwick et al patent application, for example, a p-type organic photoconductor such as the arylamine, polyarylalkane and pyrrole materials noted earlier herein. The use of the interlayer compositions described herein as a multilayer sandwich between the conducting support and the charge-generating layer of the above-described multi-active photoconductive composition has been found to provide a resultant unitary, multilayer photoconductive element having significantly enhanced adhesion and cohesive properties and substantial freedom from electrical fatigue. Such a material is particularly suitable for use as a reusable photoconductive material.

The following examples are presented to further illustrate certain representative embodiments of the invention.

EXAMPLE 1

A solution containing 3.0 g of poly(methyl methacrylate-co-methacrylic acid) in a mixture of 50 ml of 2-butanone and 50 ml of 3A alcohol (denatured ethanol) was prepared. This solution was coated onto a flexible insulating, polyester substrate carrying a conducting layer composed of cuprous iodide dispersed in a poly(-methyl methacrylate-co-vinyl acetate) binder. After evaporating the solvent, an acidic polymer layer about 0.4 micron thick was formed. On top of this layer was coated a solution of 1.5 g poly(2-vinylpyridine-co-methyl methacrylate) dissolved in 60 ml of methanol and 40 ml of denatured ethanol. After evaporating the solvent, a layer of basic polymer about 0.2 micron thick was formed. The final unitary multilayer electrophotographic element of this Example was formed by coating a single-layer, p-type organic aggregate photoconductive layer above the basic polymer layer. This photoconductive layer was applied from chlorinated solvents, and had a composition similar to that described in Table 3 of Example 1 of Contois et al, U.S. Pat. No. 3,873,311.

Tests of the coated element indicated no chemical interaction between the photoconductor and conducting layers, and essentially no change in the electrical resistivity of the conducting layer. Vigorous adhesion testing of the coated system indicated excellent adhesion and cohesion of all layers. Briefly, two types of adhesive testing were performed. In a dry adhesion test, Scotch® Brand Transparent Tape No. 600 adhesive tape sold by the 3M Co. was affixed to the unitary element under ambient room temperature and 50% relative humidity conditions. The adhesive tape was then stripped from the element to determine if separation of the photoconductive layer from the underlying conducting layer would occur. No separation of the unitary element of this example occurred when subjected to this dry adhesion test. In a wet adhesion test, the unitary photoconductive element of this example was saturated with water vapor in a chamber maintained at 120° F. for a period of 60 minutes. The element was then removed from the chamber and immediately subjected to large angle bending and flexing to determine if such stressing would cause interlayer separation of the element. Here again, no separation of the unitary element of this example was observed when subjected to this wet adhesion test. The sensitometry of the multilayer electrophotographic element of this example was found to be essentially equivalent to that of a control element in which the photoconductive layer was applied directly to a conducting metal substrate such as vacuum evaporated nickel which does not require the use of a separate electrical barrier layer. The electrophotographic element of this example was also found to perform well in a 100-cycle regeneration test, each cycle consisting of an initial uniform electrostatic charging step followed by an exposure step to discharge the element, and to function in both a positive and negative charging mode.

As controls (outside the scope of the present invention) single layer interlayer compositions were used as interlayers for multilayer photoconductive elements otherwise identical to that described immediately above. In the first control element, control A, the interlayer consisted of a single acidic polymer layer composed of the acidic polymer described hereinabove, i.e., poly(methyl methacrylate-co-methacrylic acid). This interlayer failed to provide useful adhesion as the resultant multilayer element delaminated merely upon being flexed at ambient temperature and humidity conditions. In the second control element, control B, the interlayer consisted of a single basic polymer layer composed of the basic polymer described hereinabove, i.e., poly(2-vinylpyridine-co-methyl methacrylate). However, this interlayer was essentially destroyed when the interlayer was overcoated by the above-described aggregate organic photoconductive layer applied using a chlorinated hydrocarbon solvent.

The multilayer element described above containing the multilayer interlayer composition of the present invention was examined at 2500X magnification. A photomicrograph of a cross-section of the element at 2500X magnification was made. The multilayer interlayer exhibited the characteristic irregular acid-base reaction product zone described herein and as illustrated in FIG. 2. In contrast, a third control element, element C, was prepared having a multilayer interlayer structure as described in Example 6 of U.S. Pat. No. 3,428,451, i.e., a cellulose nitrate layer over a copper iodide conducting layer and a gel subbing layer applied over the cellulose nitrate layer. Because cellulose nitrate is not an acidic polymer, one would not expect to obtain an acid-base reaction product between the cellulose nitrate layer and gel subbing layer. This expectation was confirmed by the following: A cross-section of the element (minus the overlying photoconductive layer) was examined at 2500X magnification. A photomicrograph of the cross-section was made. The structure of the multilayer interlayer composed of cellulose nitrate overcoated by gel revealed a structure like that shown in FIG. 1; that is, no acid-base reaction product zone or any other kind of separately identifiable zone or region at the interface of the cellulose nitrate-gel sub could be seen.

EXAMPLE 2

A solution containing 3.0 g of poly(methyl methacrylate-co-methacrylic acid) in a mixture of 50 ml of 2-butanone and 50 ml of denatured ethanol was prepared and coated on the conductive surface of a flexible, insulating, polyester support bearing a conducting layer comprising cuprous iodide dispersed in a poly(methyl methacrylate) binder to give, after solvent evaporation, an acidic polymer layer about 0.4 microns thick. On top of this acidic polymer layer was coated a solution of 1.5 g of poly(dimethylaminoethyl methacrylate-co-methyl methacrylate) dissolved in 60 ml of methanol and 40 ml of denatured ethanol. Upon evaporation of the solvent, a basic polymer layer 0.2 microns thick was formed. A photoconductive layer similar to that coated in Example 1 was applied over the basic polymer layer to form the electrophotographic element. Tests on the resultant multilayer element indicated the same favorable results as described in Example 1.

EXAMPLES 3–13

To demonstrate additional examples of combinations of acidic polymer and basic polymer materials useful in the present invention a series of 11 different combinations of acidic and basic polymer materials were subjected to the Acid-Base Reaction Product Formation Test as described earlier herein. In each of these tests, the common organic solvent selected was methanol. As a result, in each case there was formed an insoluble reaction product (either in the form of a precipitate or a hazy, gelatinous material) between the acidic polymer and basic polymer indicating that each of these 11 specific combinations appear to be useful in forming the multilayer interlayer compositions used in the present invention. The 11 different combinations of acidic polymer and basic polymer which were tested are set forth hereinafter in Table 1.

Table 1

| Combination No. | Acidic Polymer | Basic Polymer |
|---|---|---|
| 1 | poly(methyl methacrylate-co-methacrylic acid) | poly{N-[3-(N,N-dimethylaminopropyl)]acrylamide} |
| 2 | " | poly[styrene-co-N-(65 -dimethylaminopropyl)-maleimide] |
| 3 | " | poly(styrene-co-vinylbenzyl-dimethylamine) |
| 4 | poly(styrene-sulfonic acid) | poly(dimethylaminopropyl-acrylamide) |
| 5 | " | poly(2-vinylpyridine-co-methyl methacrylate |
| 6 | " | poly(styrene-co-N-(γ-dimethylaminopropyl)-maleimide] |
| 7 | " | poly(styrene-co-vinylbenzyl-dimethylamine) |
| 8 | poly(acrylic acid) | poly(2-vinylpyridine-co-methyl methacrylate) |
| 9 | " | poly{N-[3-(N,N-dimethylaminopropyl)]acrylamide} |
| 10 | " | poly[styrene-co-N-(γ-dimethylaminopropyl)-maleimide] |
| 11 | " | poly(styrene-co-vinylbenzyl-dimethylamine) |

EXAMPLES 14–16

To demonstrate the efficacy of the Acid-Base Reaction Product Formation Test as described herein for selection of useful acidic polymer-basic polymer combinations which will form the desired acid-base reaction product zone when actually coated as multilayer interlayer compositions in a multilayer element, acidic polymer-basic polymer Combination Nos. 4, 8, and 11 of Table 1 were used in preparing three unitary multilayer elements. Because these elements were prepared only to examine for the presence or absence of the formation of the acid-base reaction product zone characteristic of the multilayer elements of the invention, the underlying conductive layer and overlying photoconductive layer which are present in actual unitary photoconductive elements of the invention were not present in these multilayer elements. These multilayer elements were thus composed of a flexible, polyester support first overcoated with an acidic polymer layer applied from a solution composed of 2.0 g. of the particular acidic polymer dissolved in 100 ml. of methanol and then, after evaporation of the methanol solvent from the acidic polymer layer, immediately overcoated with a second layer, i.e., a basic polymer layer, applied from a solution composed of 2.0 g. of the particular basic polymer dissolved in 100 ml. of methanol. Upon evaporating the methanol from the basic polymer layer, each of the three resultant multilayer structures were examined, and each was found to possess the characteristic acid-base reaction product zone at the interface of the acidic polymer and basic polymer layers.

The invention has been described in detail with particular reference to certain preferred embodiments thereof, but it will be understood that variations and modifications can be effected within the spirit and scope of the invention.

We claim:

1. In a unitary photoconductive element comprising an electrically conducting layer, a photoconductive layer overlying said conducting layer, and a multilayer interlayer composition interposed between said conducting layer and said photoconductive layer, the improvement wherein said multilayer interlayer composition comprises a first layer containing an acidic polymer material, a second layer containing a basic polymer material, and at the interface of said first and second layers an acid-base reaction product zone formed by said acidic and basic polymer materials.

2. A unitary photoconductive element as defined in claim 1 wherein said electrically conducting layer is a hole injecting electrode, wherein said photoconductive layer comprises a p-type photoconductive material, and wherein said multilayer interlayer composition provides an electrical barrier which blocks the injection of positive charge carriers from said conducting layer into said photoconductive layer.

3. A unitary photoconductive element as defined in claim 1 wherein said acidic polymer material contains at least one repeating unit containing an acidic group selected from the class consisting of carboxyl, sulfonic, and phosphonic groups and wherein said basic polymer material contains at least one repeating unit containing as the basic group an amine group.

4. A unitary photoconductive element as defined in claim 1 wherein said acidic polymer material contains at least one repeating unit containing a carboxyl group and wherein said basic polymer material contains at least one repeating unit containing an amine group.

5. In a unitary photoconductive element comprising as an electrically conducting layer a layer containing a positive hole injecting material, a p-type organic photoconductive layer overlying said conducting layer, and a multilayer interlayer composition interposed between said conducting layer and said photoconductive layer to provide an electrical barrier which blocks the injection of positive charge carriers from said conducting layer into said photoconductive layer, the improvement wherein said multilayer interlayer composition comprises a first layer containing an acidic polymer material adjacent said conducting layer, a second layer containing a basic polymer material adjacent said photoconductive layer, and at the interface of said first and second layers an acid-base reaction product zone formed by said acidic and basic polymer materials.

6. A unitary photoconductive element as defined in claim 5 wherein said photoconductive layer comprises a solid solution of a p-type organic photoconductive and an electrically insulating polymer binder.

7. A unitary photoconductive element as defined in claim 5 wherein said photoconductive layer comprises an aggregate photoconductive composition.

8. A unitary photoconductive element as defined in claim 5 wherein said photoconductive layer comprises a multi-active photoconductive composition having an aggregate charge generation layer in electrical contact with a charge transport layer.

9. A unitary photoconductive element as defined in claim 5 wherein said acidic polymer material contains at least one repeating unit containing an acidic group selected from the class consisting of carboxyl, sulfonic, and phosphonic groups and wherein said basic polymer material contains at least one repeating unit containing as the basic group an amine group.

10. A unitary photoconductive element as defined in claim 5 wherein said acidic polymer material contains at least one repeating unit containing a carboxyl group and wherein said basic polymer material contains at least one repeating unit containing an amine group.

11. In a unitary photoconductive element comprising as an electrically conducting layer a layer containing a positive hole injecting material, a p-type organic photoconductive layer overlying said conducting layer, and a multilayer interlayer composition interposed between said conducting layer and said photoconductive layer to provide an electrical barrier which blocks the injection of positive charge carriers from said conducting layer into said photoconductive layer, the improvement wherein said multilayer interlayer composition comprises a first layer containing an organic solvent soluble, acidic polymer material adjacent said conducting layer, a second layer containing an organic solvent soluble basic polymer adjacent said photoconductive layer, and at the interface of said first and second layers an acid-base reaction product zone formed by said acidic and basic polymer materials, said acidic polymer material having at least one repeating; carboxyl group-containing unit and said basic polymer material having at least one repeating, amine group-containing unit.

12. A unitary photoconductive element as defined in claim 11 wherein said first layer of said multilayer interlayer composition comprises a copolymer of at least one carboxyl group-containing monomer and at least one compatible, non-interfering monomer and wherein said second layer of said multilayer interlayer composition comprises a copolymer of at least one amine group-containing monomer and at least one compatible, non-interfering monomer.

13. A unitary photoconductive element as defined in claim 11 wherein said acidic polymer is selected from the group consisting of poly(methyl methacrylate-co-methacrylic acid); poly(methacrylic acid), poly(ethylene-co-maleic acid), poly(vinyl hydrogen phthalate); poly(styrenesulfonic acid); and poly(acrylic acid); and wherein said basic polymer is selected from the group consisting of poly{N-[3-(N,N-dimethylaminopropyl)]acrylamide}, poly(4-vinylpyridine), poly[2-(N,N-dimethylamino)ethyl methacrylate-co-methyl methacrylate]; poly[styrene-co-N-(γ-dimethylaminopropyl)maleimide]; poly(styrene-co-vinylbenzyldimethylamine); and poly(2-vinylpyridine-co-methyl methacrylate).

14. A unitary photoconductive element as defined in claim 11 wherein said acidic polymer is poly(methyl methacrylate-co-methacrylic acid) and wherein said basic polymer is poly(2-vinylpyridine-co-methylmethacrylate).

15. A unitary photoconductive element as defined in claim 11 wherein said electrically conducting layer contains copper iodide.

16. A unitary photoconductive element as defined in claim 11 wherein said photoconductive layer contains an aggregate photoconductive composition.

17. A unitary photoconductive element as defined in claim 11 wherein the dry thickness of said multilayer interlayer compositions is within the range of from about 0.04 to about 2.0 microns.

18. In an electrophotographic imaging process wherein a photoconductive layer of a unitary photoconductive element is uniformly charged and exposed to produce a charge pattern on said element, the improvement which comprises using as said unitary photoconductive element an element as defined in claim 1.

* * * * *